United States Patent [19]

Hongo et al.

[11] Patent Number: 4,490,984

[45] Date of Patent: Jan. 1, 1985

[54] LOW-TEMPERATURE LIQUEFIED GAS CONSTANT OUTFLOW DEVICE

[75] Inventors: Akira Hongo, Miki; Hideki Ueda, Nagoya; Issei Nakata, Shizuoka; Eiichi Yoshida, Shimizu; Nobuyoshi Aoki, Shimizu; Toshimitsu Suzuki, Shimizu, all of Japan

[73] Assignees: Teisan Kabushiki Kaisha; Daiwa Can Company, Limited, both of Tokyo, Japan

[21] Appl. No.: 485,009

[22] Filed: Apr. 14, 1983

[30] Foreign Application Priority Data

Apr. 22, 1982 [JP] Japan ..... 57-67670

[51] Int. Cl.[3] ..... F17C 13/02

[52] U.S. Cl. ..... 62/49; 62/51; 62/55

[58] Field of Search ..... 62/45, 49, 50, 51, 55; 141/286, 390

[56] References Cited

U.S. PATENT DOCUMENTS 3,182,462 5/1965 Long et al. ..... 62/55
3,295,563 1/1967 Laya et al. ..... 62/55
3,938,347 2/1976 Riedel et al. ..... 62/49
4,203,299 5/1980 Dinglinger ..... 62/49

*Primary Examiner*—Ronald C. Capossela
*Attorney, Agent, or Firm*—James E. Nilles

[57] ABSTRACT

In a low-temperature liquefied gas constant outflow device having a heat-insulating container having an opening at the top, a cover member closing the opening of the heat-insulating container, a low-temperature liquefied gas outlet which runs through the base of the heat-insulating container, a level sensor which detects the level of low-temperature liquefied gas in the heat-insulating container, and a vaporized-gas exhaust conduit which opens from the cover member, the improvement wherein a pressure absorbing container is located within the heat-insulating container, a low-temperature liquefied gas supply conduit and a vaporized-gas exhaust conduit are both inserted into the pressure absorbing container through the cover member, a low-temperature liquefied gas outlet is provided in the pressure absorbing container, and a check valve is provided in the low-temperature liquefied gas supply conduit, which opens or closes in response to a signal from the level sensor.

6 Claims, 2 Drawing Figures

LOW-TEMPERATURE LIQUEFIED GAS CONSTANT OUTFLOW DEVICE

BACKGROUND OF THE INVENTION

1. Field of the Invention:

The present invention relates to a low-temperature liquefied gas constant outflow device, and more particularly to a low-temperature liquefied gas constant outflow device which provides a constant flow of a low-temperature liquefied gas such as liquid nitrogen.

2. Description of the Prior Art:

There are many fields in which it is necessary to provide a flow of low-temperature liquefied gas at an accurately constant rate.

In general, low-temperature liquefied gas is naturally of a high vaporability, and once vaporization occurs, the flow rate of the liquefied gas changes immediately. Accordingly, it is desirable to ensure that the flow of low-temperature liquefied gas is as little vaporized as possible.

The liquid pressure when low-temperature liquefied gas is being supplied to a heat-insulating container, and the vaporized gas pressure produced when the liquefied gas flows out of the supply conduit are both important factors in the change of the pressure inside the heat-insulating container. Such changes in the inner pressure of the container causes changes in the flow rate of the liquefied gas from the outflow device, the removal of which, or at least a minimization of which, is also desirable.

SUMMARY OF THE INVENTION

An object of the present invention is to provide a low-temperature liquefied gas constant outflow device which can effect a flow of liquefied gas constantly and accurately at an even rate by minimizing the evaporation of the liquefied gas as it is flowing out of the outflow device, and also by minimizing the pressure changes inside the heat-insulating container while the liquefied gas is flowing therein.

The low-temperature liquefied gas constant outflow device according to the present invention is characterized by comprising a heat-insulating container having an opening at the top, a cover member closing the opening of the heat-insulating container, a low-temperature liquefied gas outlet which runs through the base of the heat-insulating container, a level sensor insertion tube for inserting a level sensor which detects the level of the low-temperature liquefied gas in the heat-insulating container, a vaporized-gas exhaust conduit which opens from the cover member, a pressure absorbing container located within the heat-insulating container, a low-temperature liquefied gas supply conduit and a vaporized-gas exhaust conduit, both inserted into the pressure absorbing container through the cover member, a low-temperature liquefied gas opening provided in the pressure absorbing container, and a check valve inserted into the low-temperature liquefied gas supply conduit, which opens or closes in response to a signal from the level sensor.

The other objects and advantages of the present invention will be apparent from the description taken in conjunction with the accompanying drawings, in which:

DESCRIPTION OF THE PREFERRED EMBODIMENTS

Figure 1:
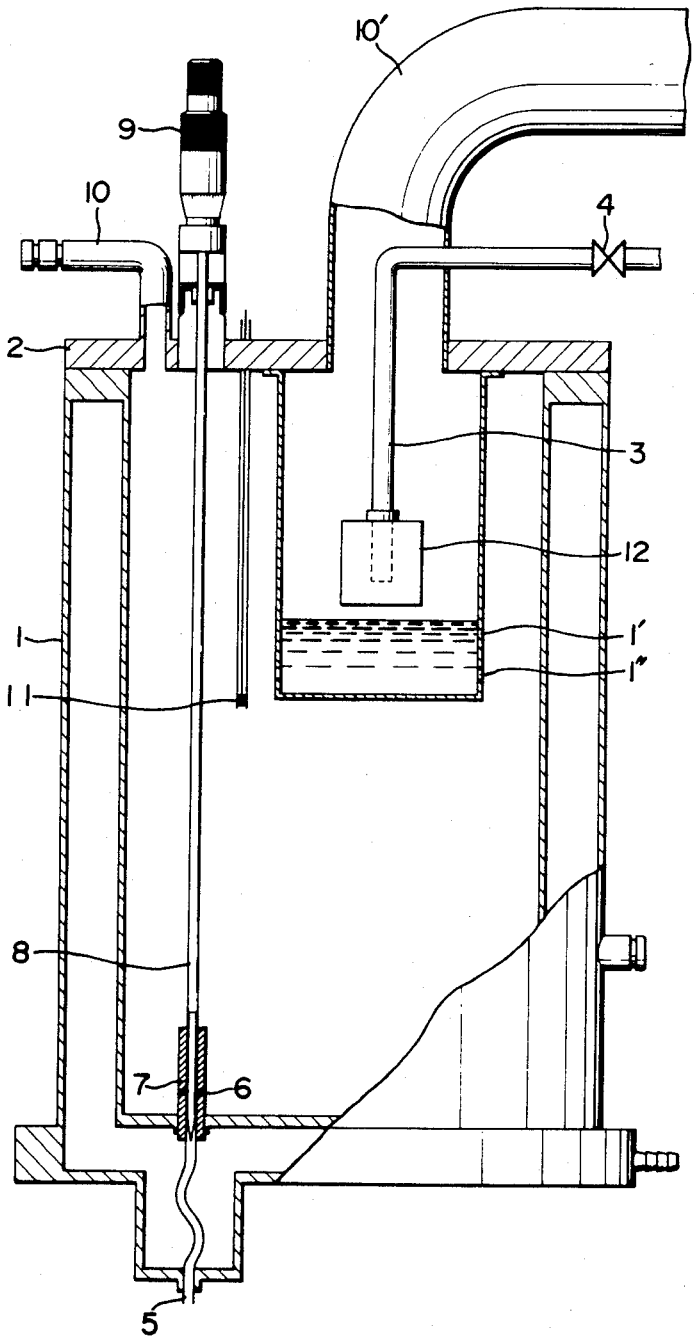
FIG. 1 is a vertically sectioned front view of a low-temperature liquefied gas constant outflow device according to an embodiment of the present invention.
Figure 2:
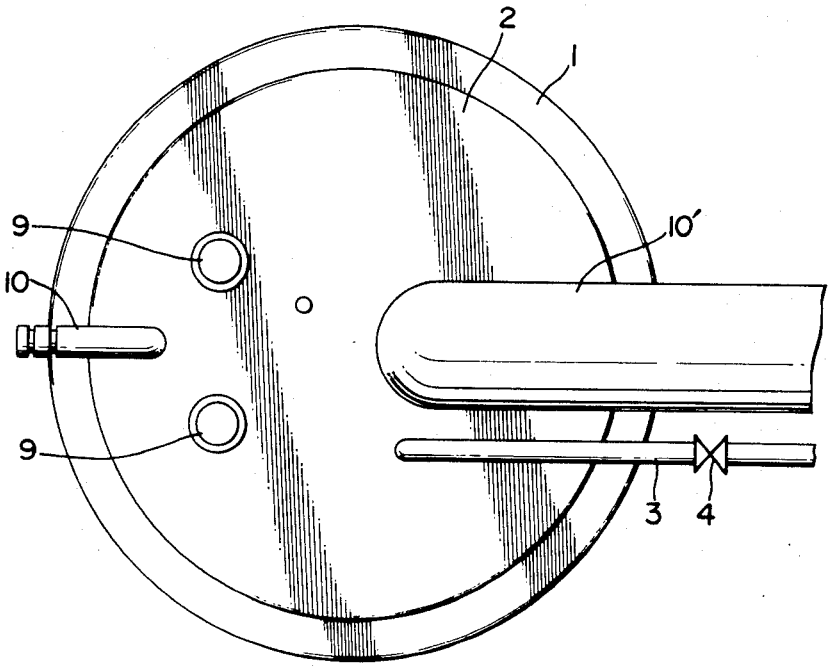
FIG. 2 is a plan view thereof.

In the low-temperature liquefied gas constant outflow device of the present invention, as shown in FIGS. 1 and 2, a heat-insulating container 1 is provided which has an opening at the top and a double-walled structure over the remaining part. The space between the outer and inner walls is kept to vacuum. A pressure absorbing container 1' is provided inside the heat-insulating container 1 and has an opening at the top. The two openings of the containers 1 and 1' are both closed by a cover member 2. A low-temperature liquefied gas supply conduit 3 is inserted into the pressure absorbing container 1' through the cover member 2, and is also connected to a low-temperature liquefied gas source (not shown) via an electromagnetic check valve 4, so that liquefied gas can be supplied into the pressure absorbing container 1'. The liquefied gas thus supplied into the container 1' is then fed to the heat-insulating container 1 through an opening 1'' pierced in the side surface of the container 1'.

A low-temperature liquefied gas outflow conduit 5 of a predetermined inner diameter is provided extending outward through the base of the heat-insulating container 1. The upper end of the liquefied gas outflow conduit 5 is connected to the lower end of a liquefied gas introduction conduit 7 which extends sufficiently far upward within the container 1 and has a liquefied gas introduction port 6 in its side surface. In this instance, it is preferable to provide a needle valve 8 inserted through the cover member 2, the needle-shaped tip of which corresponds with the opening at the top end of the liquefied gas outflow conduit 5, so that the distance between the needle-shaped tip and the top of the opening of the conduit 5 can be adjusted by a micrometer 9.

The liquefied gas outflow conduit 5, which allows for various kinds of structures other than the above one, for example, the embodiment illustrated in FIGS. 3 and 4 of Japanese Patent Application No. 56,321/1981 is not shown in detail because it is not an essential component.

The cover member 2 is pierced by a vaporized-gas exhaust conduit 10' of a sufficient size in communication with the inside of the pressure absorbing container 1', and also with another vaporized-gas exhaust conduit 10 in communications with the heat-insulating container 1.

An insertion tube for a level sensor 11 is inserted into the heat-insulating container 1 through the cover member 2. The electromagnetic check valve 4 is controlled by a signal from the level sensor 11. Numeral 12 denotes a filter provided at the end of the liquefied gas supply conduit 3.

In the low-temperature liquefied gas constant outflow device with the above construction, when the electromagnetic check valve 4 is operated so as to open by the level sensor 11, the low-temperature liquefied gas is first introduced from the gas source into the pressure absorbing container 1'. Any pressure change caused by the liquefied gas supply is effectively absorbed by the pressure absorbing container 1'. The vaporized-gas produced during this time is exhausted via the vaporized-gas exhaust conduit 10'.

The liquefied gas thus supplied to the pressure absorbing container 1' then flows naturally down into the heat-insulating container 1 through the opening 1''. Accordingly, pressure changes on the liquefied gas in the heat-insulating container 1 can be minimized, thereby obtaining a constant flow rate of liquefied gas from the outflow device.

Otherwise, in a low-temperature liquefied gas outflow device equippd with no pressure absorbing container 1' according to the present invention, since low-temperature liquefied gas is supplied directly into the heat-insulating container 1, the liquid pressure of the incoming liquefied gas and the vaporized-gas pressure produced as the liquefied gas is supplied cause changes in the pressure on the liquefied gas surface. This causes changes in the flow rate of the liquefied gas from the outflow device.

It is possible to replace the provision of the liquefied gas outflow conduit 5 and needle valve 8 by a structure in which one or more liquefied gas outflow ports are provided at the base of the heat-insulating container 1, and the flow rate of the liquefied gas from the outflow device is controlled by the opening and closing of the ports by means of a valve.

As described in the foregoing, the low-temperature liquefied gas constant outflow device is more advantageous than prior art outflow devices in that low-temperature liquefied gas can flow out constantly and accurately at an even rate.

What is claimed is:

1. A low-temperature liquefied gas constant outflow device comprising a heat-insulating container having an opening of the top, a cover member closing said opening of said heat-insulating container, a low-temperature liquefied gas outlet which runs through the base of said heat-insulating container, a level sensor which detects the level of low-temperature liquefied gas in said heat-insulating container, a first vaporized-gas exhaust conduit which opens from said cover member, a pressure absorbing container located with said heat-insulating container, said pressure absorbing container being closed and having an opening pierced in the lower portion thereof which serves as a low-temperature liquefied gas outlet, a low-temperature liquefied gas supply conduit and a second vaporized-gas exhaust conduit, both inserted into said pressure absorbing container through said cover member, and a check valve provided in said low-temperature liquefied gas supply conduit, which opens or closes in response to a signal from said level sensor.

2. A low-temperature liquefied gas constant outflow device according to claim 1, wherein said heat-insulating container has a double-walled structure, the inside of which is kept to vacuum.

3. A low-temperature liquefied gas constant outflow device according to claim 1, wherein the degree of opening of said low-temperature liquefied gas outlet running through the base of said heat-insulating container is controlled by a combination of a needle valve operation and micrometer operation.

4. A low-temperature liquefied gas constant outflow device comprising a heat-insulating container, a low-temperature liquefied gas outlet which extends through the base of said heat-insulating container, a level sensor which detects the level of low-temperature liquefied gas in said heat-insulating container, a first vaporized-gas exhaust conduit which communicates with the inside of said heat-insulating container, a pressure absorbing container located within said heat-insulating container, said pressure absorbing container being closed and having an opening in the lower portion thereof communicating with the inside of said heat-insulating container serving as a low-temperature liquefied gas outlet, a low-temperature liquefied gas supply conduit and a second vaporized-gas exhaust conduit, both communicating with said pressure absorbing container, and a check valve provided in said low-temperature liquefied gas supply conduit, which opens or closes in response to a signal from said level sensor.

5. A low-temperature liquefied gas constant outflow device according to claim 4, wherein said heat-insulating container has a double-walled structure, the inside of which is kept to vacuum.

6. A low-temperature liquefied gas constant outflow device according to claim 4, wherein the degree of opening of said low-temperature liquefied gas outlet running through the base of said heat-insulating container is controlled by a combination of a needle valve operation and micrometer operation.

* * * * *